US006601507B1

(12) United States Patent
Mallok

(10) Patent No.: US 6,601,507 B1
(45) Date of Patent: Aug. 5, 2003

(54) MARKING DEVICE FOR SHEET SIDE EDGES IN A ROTARY PRINTING MACHINE

(75) Inventor: Andreas Mallok, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 215 days.

(21) Appl. No.: 09/693,776

(22) Filed: Oct. 20, 2000

(30) Foreign Application Priority Data

Oct. 20, 1999 (DE) ..... 199 50 407

(51) Int. Cl.[7] ..... B41L 47/02

(52) U.S. Cl. ..... 101/368; 283/70; 283/38; 101/407.1; 101/485

(58) Field of Search ..... 101/368, 41, 318, 101/406, 485, 216, 407.1; 283/37, 70; 355/40; 400/624; 347/2

(56) References Cited

U.S. PATENT DOCUMENTS

| | | | | | |
|---|---|---|---|---|---|
| 1,696,999 | A | * | 1/1929 | Cannon | 101/216 |
| 4,021,876 | A | * | 5/1977 | Engelhardt | 101/41 |
| 4,145,967 | A | * | 3/1979 | Marozzi | 101/41 |
| 4,352,554 | A | * | 10/1982 | Kaye | 355/40 |
| 4,423,680 | A | * | 1/1984 | Bishop | 101/41 |
| 4,949,999 | A | * | 8/1990 | Ke-hui | 283/38 |
| 5,053,814 | A | * | 10/1991 | Takano et al. | 400/624 |
| 5,085,417 | A | * | 2/1992 | Copham | 270/1.1 |
| 5,243,394 | A | * | 9/1993 | Matsuno et al. | 347/2 |
| 5,419,256 | A | * | 5/1995 | Pollich | 101/485 |
| 5,429,391 | A | * | 7/1995 | White, II | 283/70 |
| 5,517,777 | A | * | 5/1996 | Gagnon, Jr. | 283/38 |
| 5,717,976 | A | * | 2/1998 | Chowdry et al. | 270/58.1 |
| 5,820,123 | A | * | 10/1998 | Gihr et al. | 271/236 |

FOREIGN PATENT DOCUMENTS

| | | |
|---|---|---|
| DE | 39 38 138 C2 | 5/1991 |
| DE | 42 42 731 A1 | 6/1994 |
| DE | 195 01 798 A1 | 7/1996 |
| GB | 2 273 490 B | 7/1996 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A device for laterally aligning a sheet in a sheet-processing machine, includes a marking device for automatically identifying a sheet side edge.

10 Claims, 4 Drawing Sheets

MARKING DEVICE FOR SHEET SIDE EDGES IN A ROTARY PRINTING MACHINE

BACKGROUND OF THE INVENTION

Field of the Invention

The invention relates to a marking device for automatically identifying a sheet, in particular a side edge of a sheet.

In order to finish printed sheets, such as by cutting them, folding them, and so forth, it is necessary to know which side of a sheet was aligned before the sheet was fed to the printing machine.

From the prior art, it has become known to align sheets laterally to the lefthand or righthand sides by a lateral pulling device after the sheets have been singly separated from a sheet pile and before they are fed to a printing machine. A lateral pulling device of this general type is shown, for example, in the published German Patent Documents DE 42 42 731 A1 (which corresponds to U.S. Pat. No. 5,419,256) and DE 195 01 798 A1 (which corresponds to U.S. Pat. No. 5,820,123).

SUMMARY OF THE INVENTION

It is an object of the invention to provide a marking device for side edges of sheets in a rotary printing machine, wherein laterally aligned sheets are automatically identified.

With the foregoing and other objects in view, there is provided, in accordance with the invention, a device for laterally aligning a sheet in a sheet-processing machine, comprising a marking device for automatically identifying a sheet side edge.

In accordance with another feature of the invention, the marking device includes a stamp pad.

In accordance with a further feature of the invention, the stamp pad is connected to an ink reservoir.

In accordance with an added feature of the invention, the marking device includes an ink ribbon.

In accordance with an additional feature of the invention, the aligning device includes a drivable winding device provided for the ink ribbon.

In accordance with yet another feature of the invention, the ink ribbon is stored in a replaceable cassette.

In accordance with yet a further feature of the invention, the marking device is disposed on a line in common alignment with the lateral stop.

In accordance with a concomitant feature of the invention, the marking device itself serves as a lateral stop.

Thus, it is advantageous for the invention that the printed sheet and the sheet pile, respectively, for subsequent further processing, are automatically given an identification or mark which permits a determination to be made as to which side of a sheet was aligned laterally. This identification avoids the necessity for performing so-called test cuts during the finishing of the print, which would otherwise be required in order to determine the so-called "good side".

The measure according to the invention therefore saves material and time.

In an advantageous feature of the invention, provision is made for assigning a device for providing an identification or mark for the sheet directly to a lateral stop.

The device for providing the identification or mark may be, for example, a stamp pad, or an ink or inking ribbon.

In a beneficial feature, the stamp pad is equipped with an ink reservoir, in order to supply the stamp pad with ink even over a relatively long time period.

The ink ribbon is advantageously provided with a transporting and winding device.

Configuring the ink reservoir as an ink cartridge permits simple maintenance.

Forming the ink ribbon as a cassette permits a simple replacement of a used cassette by a new one.

Other features which are considered as characteristic for the invention are set forth in the appended claims.

Although the invention is illustrated and described herein as embodied in a marking device for sheet side edges in a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
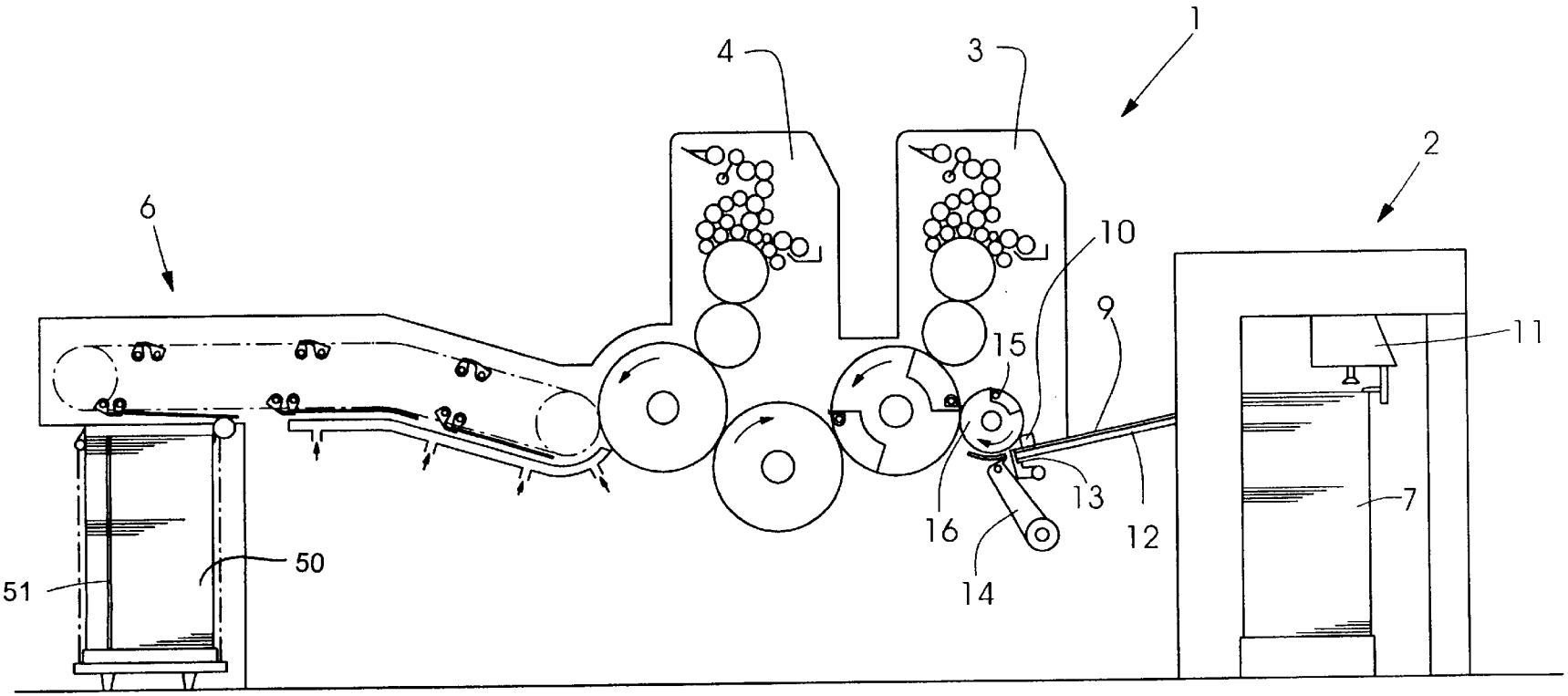
FIG. 1 is a diagrammatic side elevational view of a sheet-fed rotary printing machine incorporating the invention of the instant application.

Referring now to the drawings and, first, particularly to FIG. 1 thereof, there is shown therein a sheet-fed rotary printing machine 1 having a feeder 2, at least one printing unit 3, 4, two printing units 3 and 4 being illustrated as an example, and a delivery 6. From a feed pile 7 belonging to the feeder 2, sheets 9 are singly separated by a separating unit 11 and are fed to the sheet-fed rotary printing machine 1 via a feed table 12. At one end of the feed table 12, facing towards the printing machine, a lateral pulling device 10 for laterally aligning the sheets 9, as well as front stops 13 for aligning the leading edge of the sheets 9, are provided. After the alignment operation has been performed, the sheets 9 are taken over by a pivotably arranged pregripper 14, which transfers the sheets to a gripper device 15 of a feed drum 16 belonging to the sheet-fed rotary printing machine 1.

The lateral pulling device 10 has two pulling bars or rails 17, to which vacuum is preferably applied in order to be able to exert a holding force on the sheet 9 to be aligned. The pulling bars 17, respectively, are disposed opposite one another in the lateral handling region of the sheet 9 to be aligned, underneath the transport plane of the sheet 9 in the feed table 12.

As viewed in the sheet transport direction, a lateral stop 19 is provided at the lefthand side and at the righthand side, respectively, at which the sheet 9 is selectively aligned.

As viewed in the sheet transport direction, there is disposed immediately upline of the pulling bar 17 or cooperating directly with the pulling bar 17, respectively, a pressure roller 22 that is pivotable cyclically in rhythm with the printing-machine cycle. The pressure roller 22 is mounted in a housing 24. The pulling bar 17 is mounted so that it is displaceable transversely with respect to the sheet transport direction, the pulling movement being initiated by a control roller 26, which is rotatably mounted on an arm of the pulling bar 17. The control roller 26 cooperates with an end control face 27 of a control disk 28 that is driven at the machine cycle rate. The control disk 28 includes a control cam 29 having a height b which is corresponds to the length of the pull travel.

The housing 24 for the pressure roller 22 is rotatably mounted at one end of a lever 31 that is pivotable approximately about the center thereof. Provided at the other end of the lever 31 is a rotatably mounted control roller 32, which is in rolling contact with a control surface 33 of a control disk 34 that is drivable at the machine cycle rate. The control disk 34 has a control valley 36 formed therein. In order to align the sheet 9 laterally, the pressure roller 22 is lowered in the direction of the pulling bar 17. The control roller 32 thereby rolls on the control face 33 in the region of the control valley 36. Following the alignment, the control roller 32 is lifted off the pulling bar 17 and releases the sheet 9, in order to permit the latter to be aligned without hindrance in the circumferential direction at the front lays 13.

Figure 2:
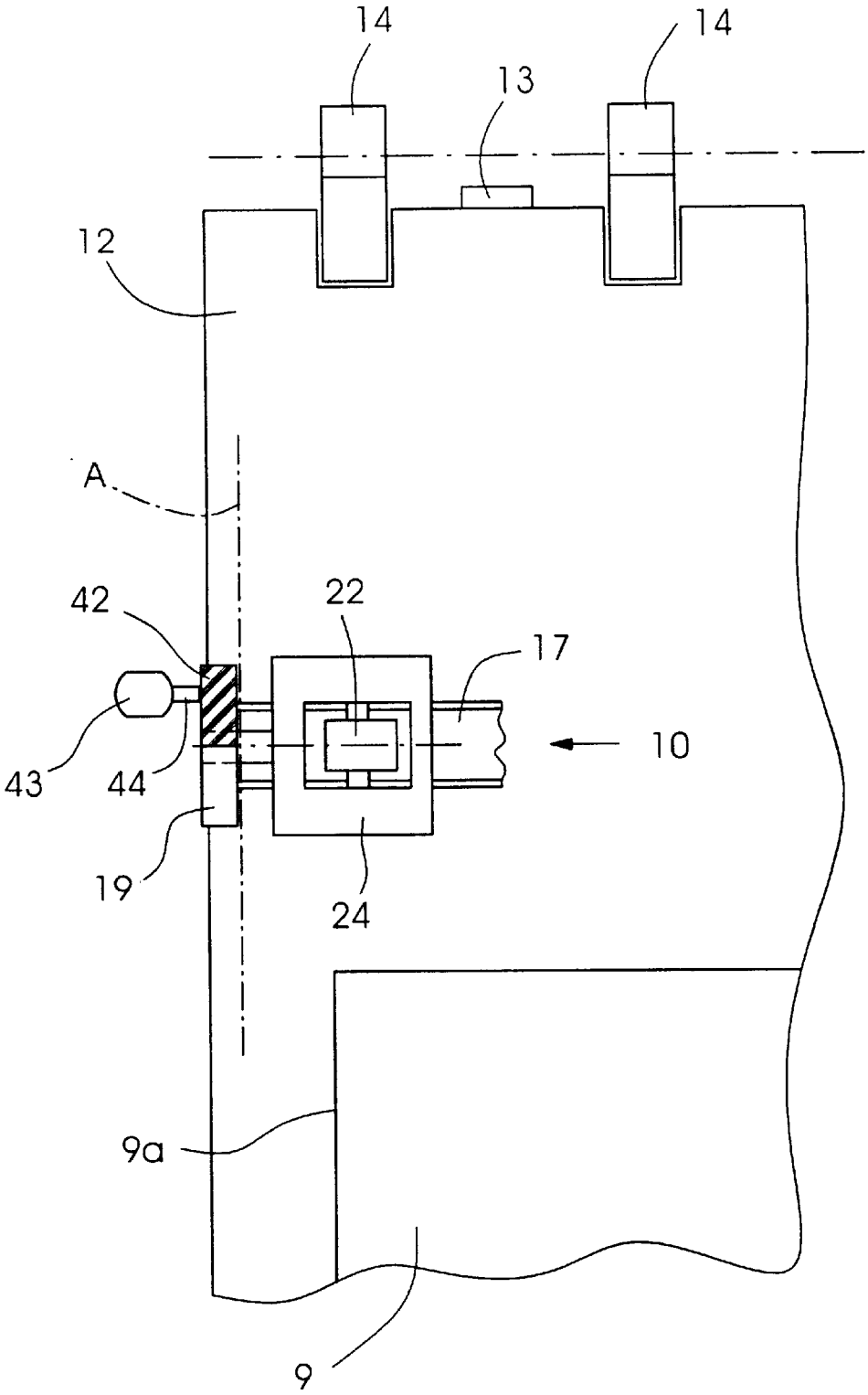
FIG. 2 is an enlarged fragmentary top plan view of FIG. 1, showing a lateral sheet-pulling device.

As FIG. 2 illustrates, the lateral stop 19 for the lateral alignment is affixed to the housing 24. In order to set the format, the complete pulling device 10 with the housing 24 is arranged so that it is displaceable transversely to the sheet transport direction by a non-illustrated spindle. The lateral stop 19 is fastened to the housing 24.

Each lateral stop 19 has a marking device 41 assigned thereto in accordance with the invention, for the purpose of identifying or marking the sheet edge 9*a*. The marking device is located on an alignment line A in common with the lateral stop 19.

Figure 3:
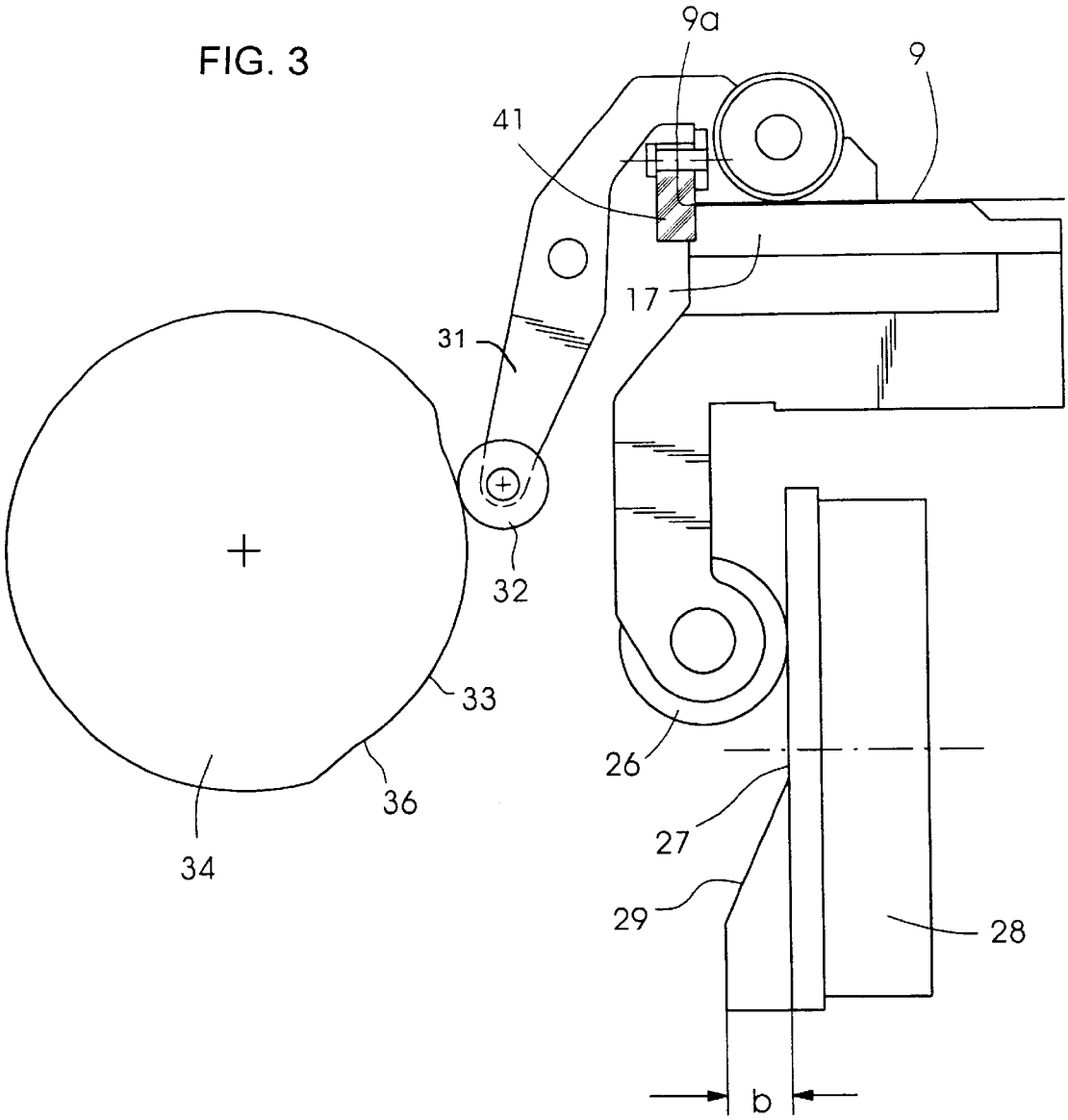
FIG. 3 is a top plan view of FIG. 2, also showing diagrammatically a control mechanism for the lateral pulling device.
Figure 3A:
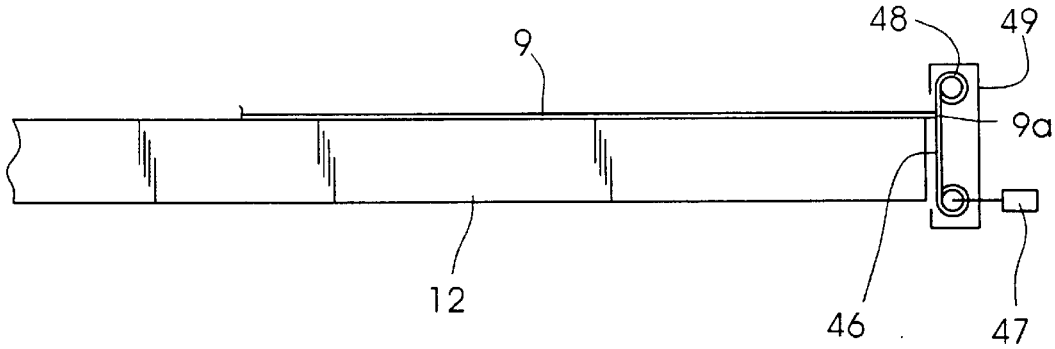
FIG. 3A is a diagrammatic side elevational view of a marking device according to the invention, which is formed as an ink or inking ribbon.
Figure 3B:
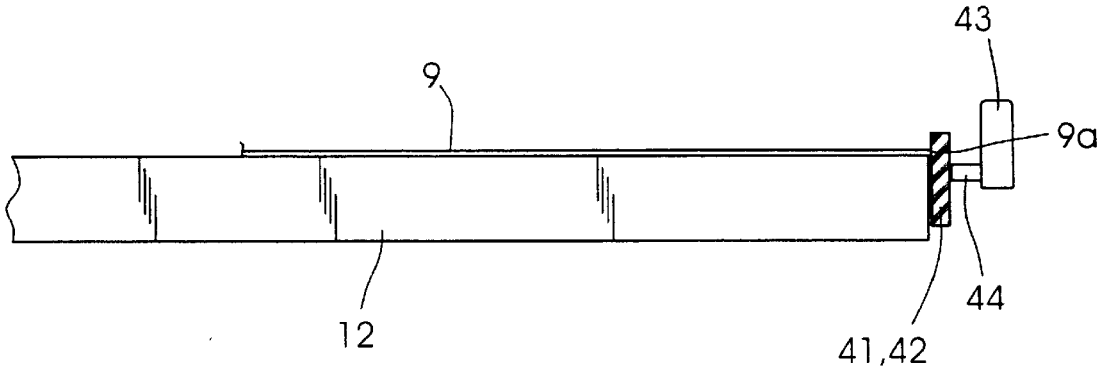
FIG. 3B is a view like that of FIG. 3A showing a different embodiment of the invention wherein the marking device is formed as a stamp pad.

In a first exemplary embodiment shown in FIG. 3B, the marking device 41 is formed as a stamp pad 42. The stamp pad 42 has an ink reservoir 43, which is connected to the stamp pad 42 via a connecting line 44, so that the pad 42 is continually supplied with ink. The ink reservoir 43 can be constructed as a refillable container or as a replaceable cartridge.

In a second exemplary embodiment shown in FIG. 3A, the marking device is formed as an ink or inking ribbon 46, which is provided with a drive 47 and a winding device 48. If the ink ribbon 46 is stored in a cassette 49, a simple replacement of the used ink ribbon 46 is possible.

During the lateral alignment of the sheet 9, for example by pulling the sheet 9 against the lateral stop 19 by the lateral pulling device 10, the sheet edge 9*a* comes into contact with the marking device 41. Due to this measure, a location on the sheet edge 9*a* is marked with a color. Following the formation of the printed sheet pile 50 in the delivery 6 of the printing machine, the pile 50, therefore, has a colored marking extending vertically in the form of a stripe 51. During the finishing of the print, this stripe 51 indicates the side whereon the sheets 9 which were in the feeder sheet pile 7 were aligned.

I claim:

1. A device for laterally aligning a sheet with a sheet side edge in a sheet-processing machine, comprising:

a marking device automatically marking the sheet side edge for identification while being aligned in the sheet-processing machine.

2. The aligning device according to claim 1, wherein said marking device includes a stamp pad.

3. The aligning device according to claim 2, wherein said stamp pad is connected to an ink reservoir.

4. The aligning device according to claim 1, wherein said marking device includes an ink ribbon.

5. The aligning device according to claim 4, including a drivable winding device provided for said ink ribbon.

6. The aligning device according to claim 4, wherein said ink ribbon is stored in a replaceable cassette.

7. The aligning device according to claim 2, wherein said marking device is disposed on a line in common alignment with a lateral stop.

8. The aligning device according to claim 2, wherein said marking device itself serves as a lateral stop.

9. The aligning device according to claim 1, wherein said marking device is an integral part of the sheet-processing machine.

10. The aligning device according to claim 1, wherein said marking device marks the sheet side edge with a colored marking.

* * * * *